US005203752A

United States Patent [19]

Frankel

[11] Patent Number: 5,203,752

[45] Date of Patent: Apr. 20, 1993

[54] HORIZONTAL LADDER FOR PLAYGROUNDS

[75] Inventor: Arie Frankel, Melville, N.Y.

[73] Assignee: American Playtime Systems, Inc., Melville, N.Y.

[21] Appl. No.: 764,351

[22] Filed: Sep. 23, 1991

[51] Int. Cl.[5] ..... A63B 9/00

[52] U.S. Cl. ..... 482/36; 482/37

[58] Field of Search ..... 482/33, 34, 35, 36, 482/37, 23, 24

[56] References Cited

U.S. PATENT DOCUMENTS

| | | | |
|---|---|---|---|
| D. 224,029 | 6/1972 | Gale et al. | 482/35 |
| 4,149,712 | 4/1979 | Murphy | 482/37 |
| 4,943,046 | 7/1990 | Beltzig | 482/37 |

*Primary Examiner*—Stephen R. Crow

*Attorney, Agent, or Firm*—Kane, Dalsimer, Sullivan, Kurucz, Levy, Eisele and Richard

[57] ABSTRACT

A horizontal ladder particularly useful in playgrounds includes two end structures, two elongated members extending between the end structures and handholds attached to the cables. Since the ladder does not need any horizontal support members it is safer to use than standard horizontal ladders.

13 Claims, 4 Drawing Sheets

HORIZONTAL LADDER FOR PLAYGROUNDS

BACKGROUND OF THE INVENTION a. Field of Invention

This invention pertains to a new horizontal ladder particularly useful for playgrounds, and more particularly to a horizontal ladder consisting of two parallel vertically oriented members without any horizontal crossmember.

b. Description of the Prior Art

A common and popular feature of playgrounds for children is the horizontal ladder normally consisting of two parallel horizontal pipes interconnected at regular intervals by cross members similar to rungs on standard ladders, and secured at the ends to two upright structures. The pipes and crossmembers are positioned at a height of 5–7 feet to allow children to "walk" along the ladder hand-over-hand. Unfortunately, frequently when children are left unattended, they use the various playground equipment improperly. For example many children try to climb on top of horizontal ladder and try to stand on it or walk across it, and fall off. Because of the height of these ladders, such falls frequently result in major injuries and even death.

OBJECTIVES AND SUMMARY OF THE INVENTION

In view of the above-mentioned disadvantage of the prior art, an objective of the present invention is to provide a horizontal ladder which greatly reduces potential injuries.

A further objective is to provide a horizontal ladder which is at least partially flexible to give more enjoyment to the children.

A further objective is to provide a horizontal ladder which is easy to manufacture from standard parts used to make other playground equipment so that it blends in aesthetically with the playground.

Briefly, a horizontal ladder constructed in accordance with this invention includes a first and a second end structure, a first and a second elongated member extending between said first and second end structures and a plurality of handholds attached to and extending downwardly from said first and second elongated members.

DETAILED DESCRIPTION OF THE INVENTION

Figure 1:
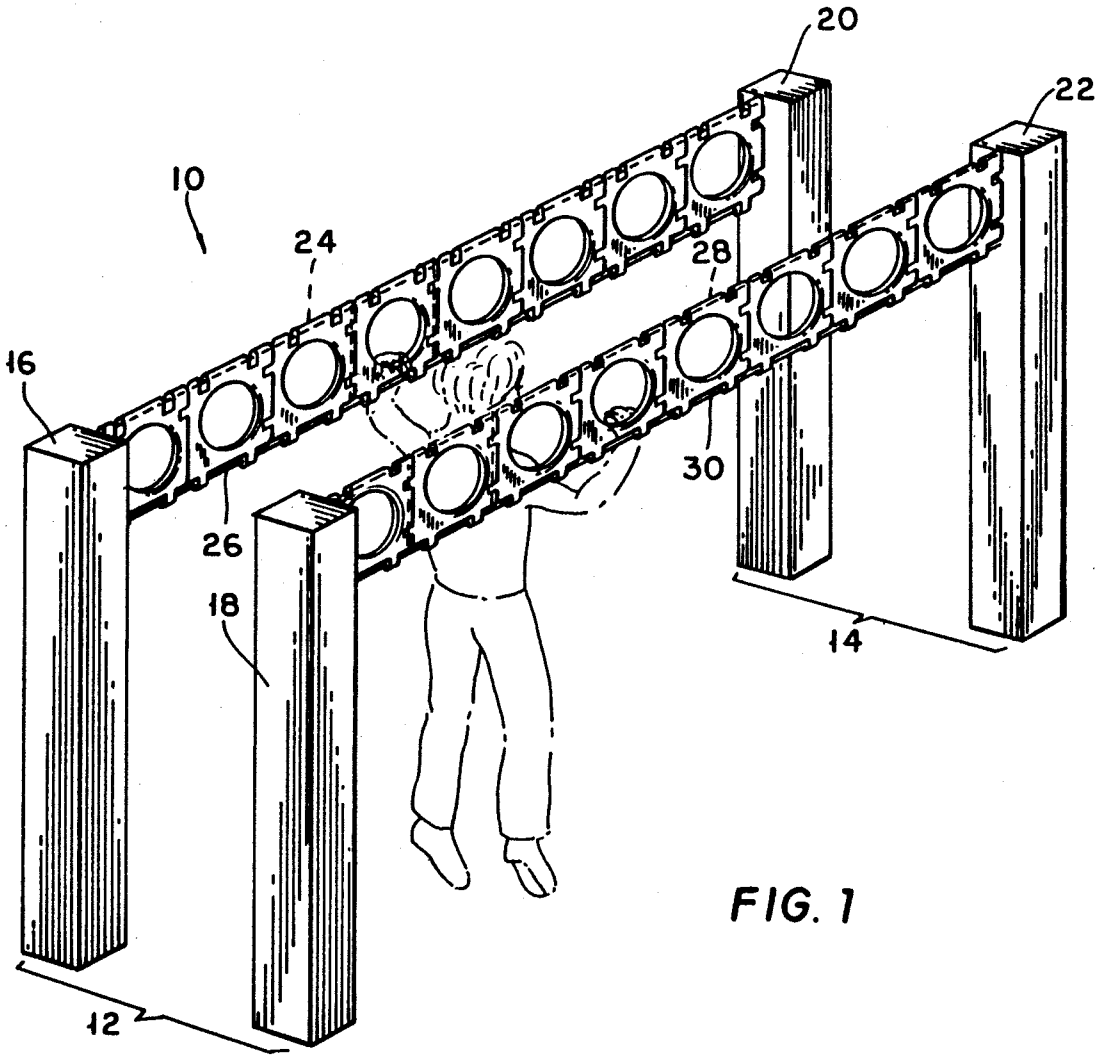
FIG. 1 shows an isometric view of a horizontal ladder constructed in accordance with this invention.
Figure 2:
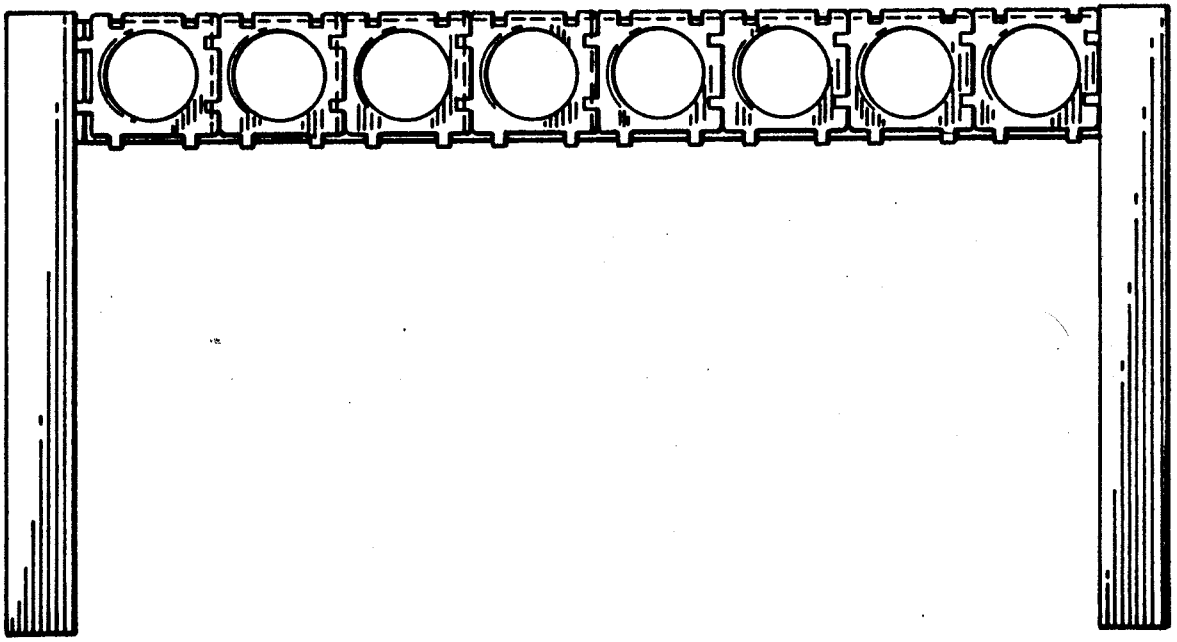
FIG. 2 shows a side view of the ladder of FIG. 1.
Figure 3:
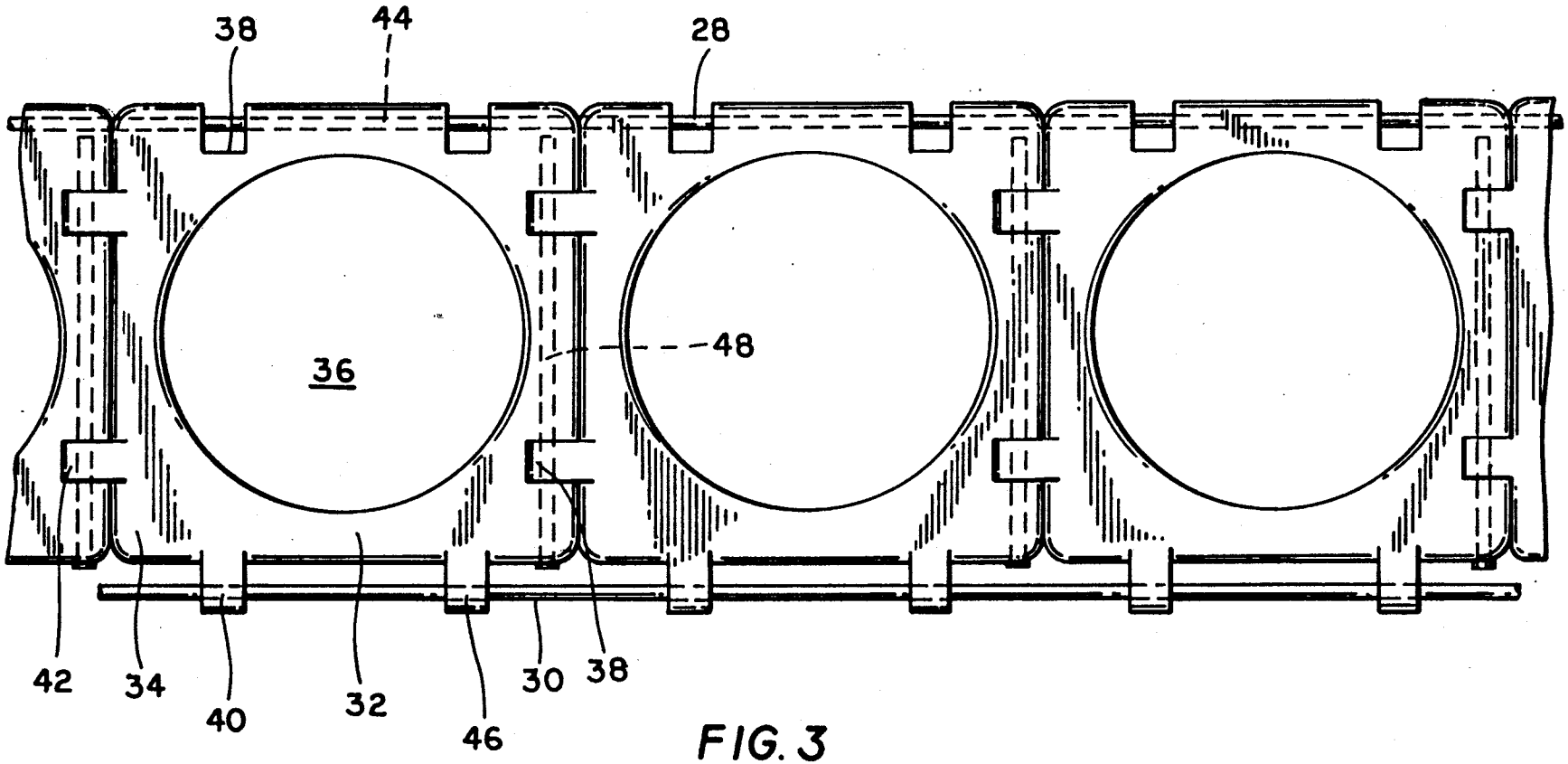
FIG. 3 shows an enlarged view of the handholds used for the ladder of FIGS. 1 and 2.

Referring now to FIGS. 1–3, a horizontal ladder 10 constructed in accordance with this invention includes a first and a second end structure 12, 14. These end structures may consist of two upright beams 16, 18 and 20, 22 spaced apart by a preselected distance. These beams may be made of wood, metal, or any other weatherproofed material. For example the inventor has found that beams made of recycled plastic is particularly useful for this purpose.

Two strong cables 24, 26 made for example of galvanized steel are secured in parallel by any well known means between beams 16 and 20. Two similar cables 28, 30 are also secured between beams 18 and 22 as shown. These cables are inherently somewhat flexible. Alternatively, rods may be used instead of cables. As shown in more detail in FIG. 3, a plurality of handholds 32 are attached to cables 24 and 28 and hang downwardly. These handholds 32 can have a variety of shapes or configurations. In the figures, handholds 32 are in the form of cells described in more detail in my co-pending application Ser. No. 688,944 entitled A MODULAR ARCHITECTURAL STRUCTURE FOR PLAYGROUNDS AND THE LIKE. Briefly, each cell 32 consists of a generally square body 34 with a round hole 36 in the middle. Along two of its edges, cell 32 has rectangular cutouts as at 38. At the other edges the cell 32 is provided with matching tongues 42. The edges with the cutouts are provided with through-holes as at 44. The tongues 42 are provided with similar through-holes as at 46. As shown in FIG. 3, the cable 28 passes through holes 44 and cable 32 passes through holes 46 thereby supporting the cells. In order to insure that the cells do not separate and pinch the fingers of a child, adjacent cells are coupled to each other by pins 48. Preferably pins 48 are sized to form an interference fit with holes 44, 46. Cells 32 are preferably made of a plastic material for example by molding.

In this manner a strong durable, horizontal ladder is made. The cells are sized and shaped so that they can be easily grasped. Importantly, since the ladder does not need any horizontal cross-members, it would be extremely difficult for children to climb up on this ladder especially since the cables give it a slight flexibility.

Figure 4:
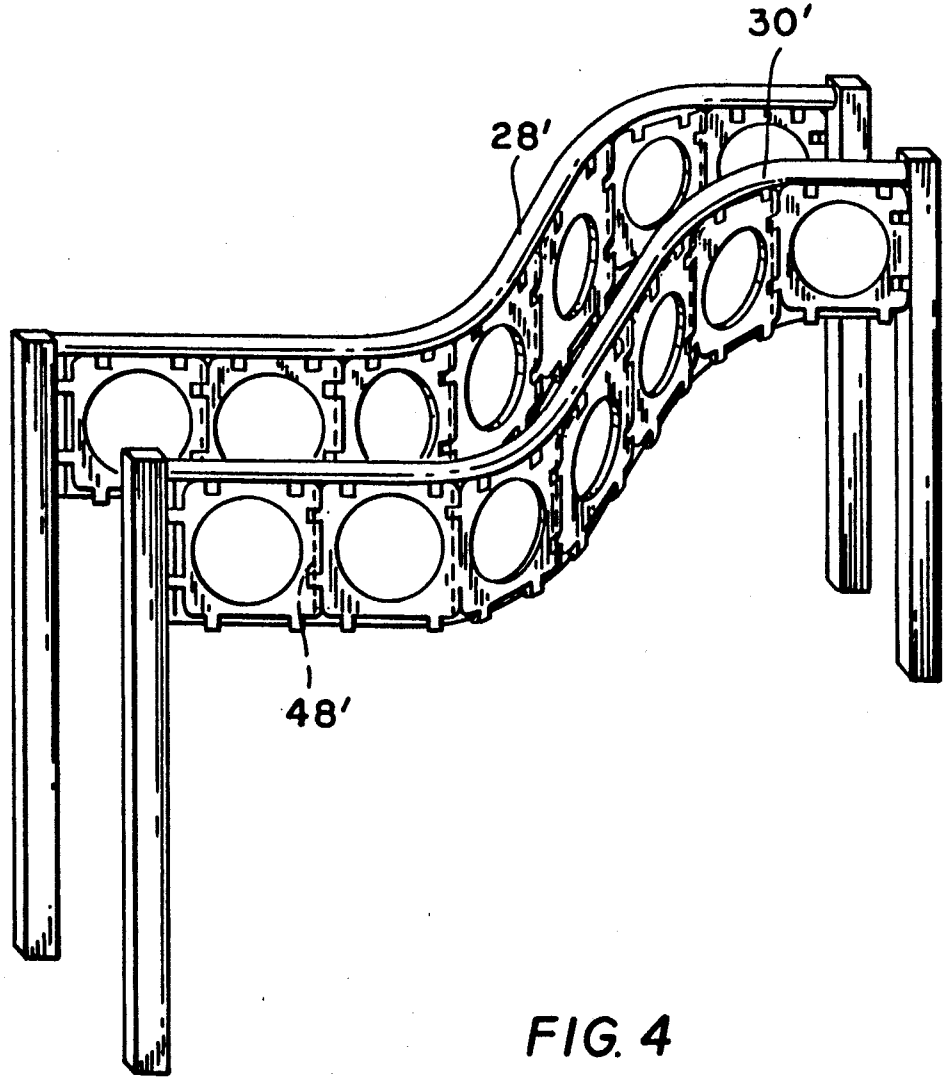
FIG. 4 shows an alternate embodiment of the invention.

In FIG. 4 an alternate embodiment is shown wherein instead of cables, the handholds are attached to two pipes 28′, 30′ shaped in any arbitrary manner. While in the embodiment of FIGS. 1–3 the handholds must extend in a straight line no such restrictions are necessary for the embodiment of FIG. 4. In this embodiment, pins 48 are attached directly to the pipes 28′, 30′.

Obviously numerous modifications may be made to this invention without departing from its scope as defined in the attached claims.

I claim:

1. A horizontal ladder for a playground comprising:

a first and a second end structure;

four cables secured between said first and second ends, said four cables including first and second upper cables, and first and second lower cables disposed substantially below said first and second upper cables, respectively; and a first set and a second set of cells arrange and constructed to form handholds for traversing from said first to said second end structure, each cell of said first set being mounted between said first upper and said first lower cable, and each cell of said second set being mounted between said second upper and said second lower cable.

2. The ladder of claim 1 wherein said cells are made of a plastic material.

3. The ladder of claim 1 wherein each cell includes an upper hole for engagement with one of said upper cables and a lower hole for engagement with said lower cables.

4. A structure for playgrounds which can be traversed hand-to-hand comprising:

an elongated support member extending horizontally;

handhold means including a flexible cable extending in parallel with and being disposed under said supper member, said handhold means being arranged for grasping with a hand; and a plurality of coupled members extending in a spaced relationship between said support member and said handhold means for supporting said handhold means.

5. The structure of claim 4 wherein said elongated support member consists of a rigid pipe.

6. The structure of claim 4 wherein said elongated support member consists of a first and a second rigid pipe extending horizontally, said first and second pipes being separate and unconnected and said handhold means includes a first flexible cable disposed under and substantially coextensive with said first pipe and a second flexible cable disposed under and substantially coextensive with said second pipe.

7. A horizontal ladder comprising:

a pair of ladder structures each;

first and second end structures; and first and second substantially coextensive longitudinal structures extending above ground between said end structures, said ladder structures being spaced at a predetermined distance to define an unobstructed space therebetween, each longitudinal structure including an elongated support member extending between said end structures; and a set of grasping means extending downwardly from said support member, said grasping means includes a plurality of hingedly coupled cells secured to one of said support members, each cell being arranged and constructed to from a handhold.

8. The ladder of claim 7 wherein said cells are identical.

9. The ladder of claim 7 wherein each said elongated member consists of a rigid element.

10. The ladder of claim 7 wherein said elongated members comprise an upper flexible cable.

11. The ladder of claim 7 wherein said elongated member comprises an upper cable, each said longitudinal structure further including a lower cable coupled to said elongated member by said grasping means.

12. The ladder of claim 7 wherein said cells are made of plastic.

13. The ladder of claim 7 wherein said cells includes holes and wherein said support means comprise cables passing through said holes.

* * * * *